US006679441B1

(12) United States Patent
Borra et al.

(10) Patent No.: US 6,679,441 B1
(45) Date of Patent: Jan. 20, 2004

(54) ELECTROHYDRODYNAMIC SPRAYING MEANS

(75) Inventors: Jean-Pascal Borra, Chevreuse (FR); Pascale Ehouran, Gif-sur-Yvette (FR)

(73) Assignee: Centre National de la Recherche Scientifique (C.N.R.S.), Paris (FR)

( * ) Notice: Subject to any disclaimer, the term of this patent is extended or adjusted under 35 U.S.C. 154(b) by 0 days.

(21) Appl. No.: 09/647,172

(22) PCT Filed: Aug. 29, 1999

(86) PCT No.: PCT/EP99/00730

§ 371 (c)(1),
(2), (4) Date: Sep. 27, 2000

(87) PCT Pub. No.: WO99/49981

PCT Pub. Date: Oct. 7, 1999

(30) Foreign Application Priority Data

Mar. 27, 1998 (FR) ..... 98 03842

(51) Int. Cl.[7] ..... B05B 5/00
(52) U.S. Cl. ..... 239/690; 239/692; 239/707
(58) Field of Search ..... 239/690–708, 239/4; 361/227, 228; 128/200.14, 203.13, 204.13, 204.21

(56) References Cited

U.S. PATENT DOCUMENTS

| | | | | | |
|---|---|---|---|---|---|
| RE30,479 | E | * | 1/1981 | Cohen et al. | 55/10 |
| 4,264,641 | A | * | 4/1981 | Mahoney et al. | 427/30 |
| 4,658,269 | A | * | 4/1987 | Rezanka | 346/75 |
| 4,748,043 | A | * | 5/1988 | Seaver et al. | 427/30 |
| 5,813,614 | A | * | 9/1998 | Coffee | 239/690 |
| 6,105,571 | A | * | 8/2000 | Coffee | 128/200.14 |

* cited by examiner

*Primary Examiner*—Dinh Q. Nguyen
(74) *Attorney, Agent, or Firm*—Burns, Doane, Swecker & Mathis, L.L.P.

(57) ABSTRACT

The invention concerns electrohydrodynamic spraying means enabling electrohydrodynamic spraying, in the air and at atmospheric pressure, of liquids with high surface tension such as water. The means are characterised in that they comprise at least a liquid dispensing conduit (1) whereof the dimensions of the external diameter and of the internal diameter, at the liquid exit point, correspond to an appropriate ratio. Said means can be advantageously used for depolluting aerosol effluents, or transformable into aerosols.

24 Claims, 6 Drawing Sheets

ELECTROHYDRODYNAMIC SPRAYING MEANS

Figure 1:
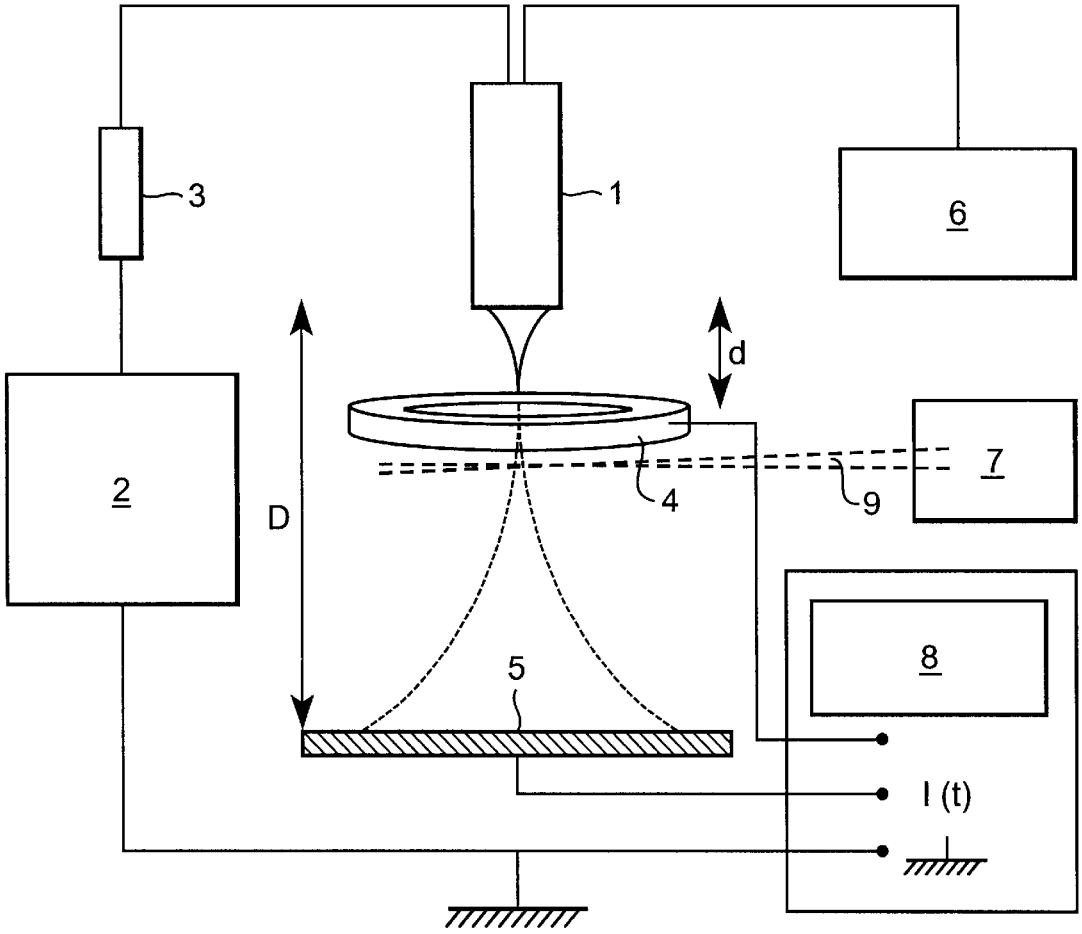

The present invention relates to electrohydrodynamic spraying (hereafter called EHDS) means.

EHDS is a means of producing sprays of electrically charged liquid droplets of millimetric, micron or submicron size.

EHDS essentially consists in applying an electric field to a liquid so as to induce, on the surface of this liquid, electric charges of the same polarity as the voltage applied to it. These charges, accelerated by the electric field, cause the drop of liquid to be transformed into a cone. A jet of liquid is produced at the apex of this cone, which jet fragments into droplets (spray) of millimetric, micron or submicron size.

Various liquid fragmentation modes may be obtained and have been described in the prior art (cf. especially Cloupeau and Prunet-Foch, 1989, J. Electrostatics 22, pp. 135–159). Mention may especially be made of the "drop-by-drop" mode which produces millimetric drops and the stable "cone-jet" mode which produces a bimodal particle size distribution of the spray (micron drops and submicron satellites).

Various means have been described in the prior art for making it possible to obtain an EHDS in stable "cone-jet" mode (a mode guaranteeing bimodal dispersion) in the case of liquids whose surface tension at room temperature is less than or equal to 0.055 N/m, such as ethanol, acetone and ethylene glycol. However, EHDS in "cone-jet" mode poses a problem in the case of liquids having a high surface tension, such as water or else liquids to which reactants or active principles having a surfactant effect have been added.

This is because the high surface tension of these liquids means that high potentials have to be applied to the liquid in order to produce an EHDS from them, this in turn creating a large electric field in the gas surrounding the liquid and, consequently, creating ionization phenomena in the gas. In air, at atmospheric pressure, these electrical discharges are mostly of pulse duration (dart leaders) and prevent the establishment of a "cone-jet" fragmentation mode in favour of a "cone-jet-glow" mode.

Thus, EP 0,258,016 describes an electrostatic spray system intended to allow the application of very thin surface coatings. This system is capable of spraying, in air at atmospheric pressure, liquids whose surface tension is less than 0.065 N/m, and preferably less than 0.050 N/m, but this is so only if the corona-type phenomena are avoided ("cone-jet" mode of fragmentation of the liquid). If discharges were to appear, EP 0,258,016 indicates that its device must be placed in a gas other than air, or in an atmosphere different from at atmospheric pressure. The teaching of EP 0,258,016 therefore leads a person skilled in the art to avoid discharge phenomena, which are regarded as spray destabilizers.

Various approaches have been proposed in the prior art for stabilizing the EHDS of such liquids, by preventing the formation of pulsed discharges in the gas surrounding them. Two types of approach may be identified: a first type of approach uses an increase in the dielectric strength of the gas surrounding the liquid by increasing the pressure of the gas and/or by employing gases other than air, such as $CO_2$ or $SF_6$; a second type of approach uses an additional electrode placed near the cone and near the jet of liquid so as to reduce the radial electric field in the gas near the liquid. However, neither of these types of approach is satisfactory from the industrial standpoint: the first type requires means of controlling the atmospheric environment and the second type requires an additional high-voltage source.

To the knowledge of the Applicant, none of the devices described in the prior art therefore allows, in the case of liquids having a high surface tension, such as water, EHDS in air and at atmospheric pressure, without generating a pulsed discharge regime and without requiring the use of an additional electrode.

The present application relates to novel means allowing this problem to be solved and is aimed at overcoming the drawbacks of the means of the prior art.

In fact, the inventors have for the first time confirmed that an EHDS without a pulsed discharge regime could be established directly in air and at atmospheric pressure for liquids whose surface tension, as measured at room temperature, is greater than 0.055 N/m and, notably, greater than 0.065 N/m. They have in particular confirmed that such an EHDS can be obtained using an EHDS device complying with certain operating parameters and, most essentially, using an EHDS device comprising at least one liquid delivery duct 1 whose external diameter and internal diameter values, at the point of emergence of the biased liquid, satisfy an appropriate relationship within a predefined range of external diameters (cf. examples and graph in FIG. 2 below). Such a relationship may especially correspond to a ratio of the (external diameter value) to the (internal diameter value) of greater than or equal to a fixed limiting value.

The inventors have in fact observed that the discharge regime in the gas (a continuous discharge regime—stabilizing glow—or a pulsed discharge regime—destabilizing dart leaders) is directly related to the divergence of the field in the gas. They have thus confirmed that, for liquids whose surface tension is greater than 0.055 N/m and, notably, greater than 0.065 N/m, it is essential, in order to produce the desired EHDS in air at atmospheric pressure, to choose external and internal diameters which make it possible to control:

- the shape of the liquid, that is to say the geometry of the cone and of the jet of liquid; and
- the potential drop in the liquid, that is to say the potential at the surface of the liquid; so as to control the divergence of the field in the gas (that is to say the variation in the electric field in the gas).

Thus, the first subject of the present invention is an electrohydrodynamic spray device comprising at least one duct 1 at one outlet of which a biased liquid can be sprayed. The device according to the invention makes it possible to spray, in air, at atmospheric pressure, a liquid whose surface tension, as measured at room temperature, is greater than 0.055 N/m and, notably, greater than 0.065 N/m, without generating a pulsed discharge regime. A means for demonstrating the absence of such a pulsed discharge regime comprises the measurement of the time variation of the current using a high-speed oscilloscope. According to one advantageous aspect, the device according to the invention is capable of spraying, in air and at atmospheric pressure, a liquid whose surface tension is greater than 0.055 N/m and, notably, greater than 0.065 N/m, by generating a continuous discharge regime, such as a corona-type discharge regime (or glow regime or Hermstein regime).

The device according to the invention is thus characterized in that it comprises means, and especially means of external and internal diameters, of the duct 1, at the very least at the said outlet of the duct 1, which spray, in air and at atmospheric pressure, a liquid whose surface tension, as measured at room temperature, is greater than 0.065 N/m, by generating a continuous discharge regime, such as a corona-type regime (or glow regime or Hermstein regime). Various means are known to those skilled in the art for monitoring the continuous nature of a discharge regime. Mention may especially be made of measurement of the electric current using a high-speed oscilloscope, the visual checking of the stability of the liquid cone formed and/or the particle size distribution measurements used for confirming the bimodal nature of the droplet size distribution. Such a bimodal distribution may especially correspond to a first, major droplet population (corresponding for example to 90% of the liquid volume sprayed), of larger average droplet size and to a second, minor droplet population (corresponding for example to 10% of the liquid volume sprayed), of finer average droplet size.

By the term "electrohydrodynamic spray device" we mean, in the present invention, a device capable of generating a spray (or dispersion) of biased liquid, that is to say a spray of liquid fragmented, or sprayed, into electrically charged droplets. Such a device therefore comprises means for feeding and for delivering liquid, and means for electrically biasing the surface of this liquid. The means for delivering liquid are provided by a duct 1 or capillary 1, at one outlet of which the biased liquid forms a conical meniscus, from the apex of which a jet, and then a dispersion of electrically charged liquid droplets, leaves.

By the term "surface tension" we mean in the present application the surface tension as measured in air at room temperature and at atmospheric pressure.

The device according to the invention, designed so as to allow EHDS in a continuous discharge regime, in air and at atmospheric pressure, of liquids whose surface tension is greater than 0.055 N/m and, notably, greater than 0.065 N/m, has the advantage of allowing, without any modification of the said device, the EHDS of liquids whose surface tension is less than or equal to 0.055 N/m.

According to one advantageous arrangement of the invention, the said means comprise, at the very least at the said outlet of the duct 1, external and internal diameter values which, when they are expressed in the same units, satisfy the following relationship: external diameter value/internal diameter value greater than or equal to approximately 1.445, preferably greater than or equal to approximately 1.5697, more preferably greater than or equal to approximately 1.6 and even more preferably greater than or equal to approximately 1.8.

The upper bound of the values suitable for this (external diameter value)/(internal diameter value) ratio is defined by various technical limits. Mention may in particular be made of the technical limits associated with the machining of a very small internal diameter, or else those due to the pressure drop which may result from a smaller internal diameter and which therefore requires, as compensation, higher-pressure hydraulic systems.

The lower bound of the values suitable for the (external diameter value)/(internal diameter value) ratio is obtained from experimental measurements (observation of the formation of a stable EHDS as a function of a range of external and internal diameter values). Examples of such measurements are given in the "Examples" part below. The lower bound value depends, of course, on the experimental conditions applied. Examples of suitable devices and of their use are described in FIG. 1 and in the "Examples" part below. However, a person skilled in the art may devise, and implement, variants thereof. Thus, a person skilled in the art may, of course, take into account the material and/or the arrangement of the support which supports the said duct or capillary, insofar as this material and/or this arrangement can affect the electric field produced. It will in fact be apparent to a person skilled in the art that the choice of whether or not to have such a support made of a conducting material, particularly when it is placed perpendicular to the axis of the said duct 1 or capillary 1, substantially influences the experimentally measured lower bound of the said suitable values of the (external diameter value)/(internal diameter value) ratio. Thus, the abovementioned 1.5697 lower bound value is obtained from experimental measurements carried out with such a support being present, whereas the abovementioned 1.445 lower bound value is obtained from experimental measurements carried out under comparable conditions, but with such a support not being present.

It should also be emphasized that the measurements carried out, and consequently, the lower bound value obtained, also depend on the profile of the section at the said outlet of the duct or capillary. The abovementioned 1.445 lower bound value is thus obtained when the said duct, or capillary, has at the very least at the said outlet a sharp cross section (right-angled face): the cross section perpendicular to the axis of the said duct 1, or capillary 1, at the said outlet has an annular profile. When the outlet cross section is not perpendicular to the edge of the duct 1 or capillary 1, the lower bound value obtained may be substantially different. Thus, when the external face of the duct 1 or capillary 1 appears, at the very least at the said outlet, longer than the internal face (non-right-angled face, i.e. a bevelled-type profile), the lower bound value may appear lower (a value of 1.38 has been observed under these conditions, compared with the 1.445 value obtained using an outlet cross section perpendicular to the edge of the duct 1 or capillary 1. Conversely, when the external face appears, at the very least at the said outlet, shorter than the internal face (bevelled-type profile), the lower bound value may appear higher (a value of 1.8 has thus been obtained under these conditions, compared with 1.445 obtained using sharp cross sections of annular profile. A person skilled in the art will therefore be able to be choose to machine a particular profile over the cross section at the said outlet of the duct 1 or capillary 1.

A suitable value of the said external diameter depends especially on the electrical relaxation constant of the liquid $\tau_q$ (which is itself a function of the conductivity of the liquid). Advantageously, it is less than a limiting value $D_{max}$ which satisfies, in the case of a liquid having a high viscosity, the equation:

$$\log_{10}(D_{max})=0.37793\times\log_{10}(\tau_q)+0.34674$$

where $D_{max}$ is the said limiting value in m and $\tau_q$ is the electrical relaxation constant of the said liquid in s or, in the case of a liquid having a low viscosity, the equation:

$$\log_{10}(D_{max})=0.37747\times\log_{10}(\tau_q)+0.43141$$

where $D_{max}$ and $\tau_q$ are as defined above. The terms "low" viscosity and "high" viscosity should be understood to mean those in accordance with the notions commonly accepted by a person skilled in the art. Typically, "low" viscosity should be understood to mean a viscosity of approximately 1 mPa·s whereas a "high" viscosity should be understood to mean a viscosity approximately two order 25 of magnitude higher (i.e. of the order of approximately 100 mPa·s). Preferably, the value of the said external diameter is less than half of this limiting value $D_{max}$. When the said external and internal diameters have values whose ratio satisfies a relationship specified above (greater than or equal to approximately 1.445, preferably greater than or equal to approximately 1.5697, more preferably greater than or equal to approximately 1.65 and even more preferably greater than or equal to approximately 1.8), the value of the said external diameter is preferably less than one third of this limiting value $D_{max}$.

In one embodiment of the invention, the said device comprises at least one duct 1 which, at the very least at the said outlet, essentially consists of a capillary 1, such as a syringe needle. Preferably, the said device comprises a plurality of such ducts 1 or capillaries 1.

According to another advantageous aspect, the device according to the invention is capable of spraying, in air and at atmospheric pressure, a liquid whose surface tension is greater than 0.055 N/m and, notably, greater than 0.065 N/m, in a stable liquid fragmentation mode, especially in a stable "cone-jet-glow" fragmentation mode (i.e. in a "cone-jet" mode on which continuous discharges are superposed). A person skilled in the art can check whether a "cone-jet-glow" mode, i.e. the superposition of a continuous discharge regime and a cone-jet spray mode, is obtained with the aid of known means. Mention may especially be made of electrical measurements using a high-speed oscillo-scope, which measurements can be used to confirm that the current is continuous (no pulses) and that it is greater than the theoretical "cone-jet" current.

By the term "stable" we mean in the present application a permanent phenomenon (probability of it occurring over time greater than or equal to 0.9, preferably greater than or equal to 0.95 and more preferably equal to 1).

The device according to the invention furthermore comprises means making it possible to electrically bias the said liquid upstream of, or while it is flowing through, the said duct 1, especially means 2 allowing an electrical voltage to be applied to the said liquid upstream of, or while it is flowing in, the said duct, so as to bias it.

Any voltage allowing a stable EHDS to be obtained is appropriate. Its choice depends on the desired bias. Advantageously, this voltage is a DC voltage. The device according to the invention then produces sprays, the charge of which always has the same sign (that of the DC voltage applied). This voltage may just as well be positive as negative, depending on the intended applications. In one advantageous embodiment of the invention, the said voltage is a DC voltage, preferably a positive DC voltage such as a positive DC voltage less than approximately +30 kV. A person skilled in the art may choose a suitable voltage depending on the intrinsic properties of the liquid used in the device according to the invention, especially on its conductivity, viscosity, density and surface-tension properties and depending on intrinsic properties of the device, especially on the distance which separates the said duct outlet from the closest ground point.

Advantageously, the said means allowing such an electrical voltage to be applied to the said liquid essentially consist of at least one high-voltage generator 2 which, on the one hand, can be connected to ground and, on the other hand, can be connected to the said liquid either directly upstream or while it is flowing in the said duct, or indirectly via a conducting material in contact with the said liquid upstream or while it is flowing in the said duct. The said duct may in fact comprise an electrically conducting material on its internal surface, or on an internal thickness, and/or essentially consists of such a material.

In order to limit the current in the said liquid resulting from the application of the said voltage, the device according to the invention may furthermore, for safety reasons, comprise a protective resistor 3 making it possible to limit the current in the sprayed biased liquid, especially a protective resistor making it possible to limit the discharge current in the said liquid should a very high current flow. Such a resistor may advantageously be placed between the said high-voltage generator and its point of connection to the said liquid.

According to one particular embodiment of the invention, the said device furthermore comprises means 5 making it possible to debias the said liquid after spraying, that is to say making it possible to discharge the liquid droplets produced by contact with a grounded surface. According to one advantageous arrangement of this particular embodiment, the said means 5 allowing the said liquid to be debiased after spraying are placed at a distance D, hereafter called inter-electrode distance, advantageously greater than the minimum distance which allows the arc to pass before the EHDS has been established. However, such means are optional: when the said device is used for the purpose of producing a spray whose polarity has to interact with components of reverse polarity, these means are not applicable.

According to an advantageous embodiment of the invention, the said device furthermore comprises means 4 making it possible, when spraying the said liquid, to collect a discharge current in the gas surroundings the said biased liquid, such as especially a conducting material having an opening of shape and size allowing the sprayed liquid to flow, while collecting the said current of gaseous ions created by electrical discharges in the gas. Such means 4 are particularly appropriate when the said device is used for the purpose of producing a spray whose polarity has to interact with components of reverse polarity. They are also appropriate for ensuring that the field at the surface of the liquid in the production region remains independent of the + or − charge densities below the annulus (coagulation, charge-modulation and neutralization phenomena).

These means 4 then make it possible to remove gaseous ions which have the same polarity as the said spray and which, consequently, could interfere with the desired interaction between spray and components, and thus reduce the effectiveness of the device according to the invention. The device according to the invention is thus capable of controlling the discharge regime over a wide operating range, typically over voltage ranges of the order of several thousands of volts.

Such means 4 for collecting a discharge current make it possible especially to collect the gaseous ions created by such a discharge current, without correspondingly collecting the liquid droplets produced. Such a particularly appropriate means 4 consists of a counterelectrode, or conducting material connected to ground, placed at a distance from the said duct outlet and having an opening allowing the liquid droplets produced to flow, while collecting the gaseous ions created by a discharge. Said distance may especially be determined by trial and error, by moving the said means translationally along the axis of the liquid spray produced until non-separation of the liquid droplets and effective collection of the said discharge current are obtained. Such a means may especially have an annular shape.

The device according to the invention furthermore comprises means 6 allowing the said duct to be fed with liquid. The said duct may especially be fed with liquid using one or more pumps or using a tank which has a liquid height suitable for controlling the flow rate.

According to another advantageous embodiment of the invention, the said device furthermore comprises means 6 allowing a mean operating liquid flow rate at the inlet, or inside the said duct, having a value in $m^3 \cdot s^{-1}$ which lies within a range varying by a factor of approximately 10 between its upper bound and its lower bound, the said range comprising, preferably centrally, a value able to satisfy the following formula:

$$A[(4/3)\pi r^3]\tau_q,$$

A being a constant, different from 0 and from 1, lying between approximately 0.1 and 10 and preferably equal to approximately 0.5, r being the desired drop radius expressed in m and $\tau_q$ being the electrical relaxation constant of the said liquid expressed in s.

For liquids whose surface tension is less than or equal to 0.055 N/m, that is to say in the absence of any discharge problem, a person skilled in the art knows that the "cone-jet" mode can be achieved by choosing a mean operating flow rate equal to $[(4/3)\pi r^3]/\tau_q$, r being the desired drop radius (in m) and $\tau_q$ being the electrical relaxation constant (in s). It is recalled here that: $\tau_q=[\epsilon_0\epsilon_r]/\lambda=[8.92\times10^{-2}\ \epsilon_r]/\lambda$, $\lambda$ being the conductivity of the liquid in s/m, $\epsilon_0$ being the permittivity of free space and $\epsilon_r$ being the relative permittivity of the material ($\epsilon_r$=the ratio of the absolute permittivity of the material to the permittivity of free space).

For liquids whose surface tension is greater than 0.055 N/m and, notably, greater than 0.065 N/m, the inventors have established that the appropriate mean operating flow rate for liquids having a surface tension of less than or equal to 0.055 N/m at ambient temperature, as indicated above, must be corrected by a constant factor A, differing from 0 and from 1, lying between approximately 0.1 and 10 and preferably equal to ½, so as to prevent a pulsed discharge regime from destabilizing the spray.

The device according to the invention may therefore furthermore comprise liquid feed means 6 allowing a mean operating liquid flow rate at the inlet of the said duct, the value in $m^3 \cdot s^{-1}$ of which satisfies the following formula:

$$A[(4/3)\pi r^3]/\tau_q,$$

A being a constant different from 0 and from 1, lying between approximately 0.1 and 10 and preferably equal to approximately 0.5, r being the desired drop radius expressed in m and $\tau_q$ being the electrical relaxation constant of the said liquid expressed in s.

According to another aspect of the invention, the said device furthermore comprises means making it possible to measure the particle size distribution of the dispersion produced by spraying the said biased liquid, and especially a system of the LDA (Laser Doppler Anemometry) type, and/or means for measuring the electric current carried by the dispersion produced by spraying the said biased liquid, and especially an oscilloscope. Such means make it possible in particular to monitor the change in particle size distribution of the droplets produced and/or the change in the said current while the said liquid is being sprayed.

According to an advantageous aspect of the invention, the said liquid is essentially a solution (solvent and neutral or ionic, organic or mineral solute(s)), or a mixture of solutions chosen from the group consisting of water, ultrapure water, distilled water, water containing conducting salts, an organic solvent to which one or more surfactant molecules have been added, ethanol to which one or more surfactant molecules have been added, acetone to which one or more surfactant molecules have been added and ethylene glycol to which one or more surfactant molecules have been added.

The device according to the invention has many beneficial applications. These encompass all the known applications of EHDS devices in general, such as surface coating or deposition, to which applications may be added novel applications now able to be carried out using the device according to the invention because of its ability to spray, in air and at atmospheric pressure, a liquid whose surface tension is greater than 0.055 N/m and, notably, greater than 0.065 N/m, without generating a pulsed discharge regime. Mention may especially be made of applications in the field of electrical particle washing and in the biological field.

According to a preferred embodiment of the invention, the said device is applied to the separation of particles, and especially of polluting particles, present in an aerosol (dust extraction). This applies to any effluent in the aerosol state or to any effluent which can be converted into an aerosol. Such a separation is achieved by electrical coagulation of the said particles to be removed onto the said liquid droplets produced by the device according to the invention; for such a coagulation to take place, the said device is then applied to the production of liquid droplets having the reverse polarity to the (natural or induced) polarity of the said particles to be removed.

The device according to the invention is therefore, in a preferred embodiment of the invention, placed in a stream of industrial effluent from which dust has to be removed, in which a spray may be produced having a polarity the reverse of that of the particles of the aerosol effluent using liquid(s) having a surface tension greater than 0.055 N/m and, notably, greater than 0.065 N/m, such as water. Particularly advantageously, a plurality of devices according to the invention are placed in such an effluent stream.

Compared with the devices of the prior art for the separation of aerosols, such as especially a fluidized bed and wet scrubber, the device according to the invention has especially the advantage of producing finer-sized charged liquid droplets and, in the case of application to the separation of polluting particles in an aerosol, of limiting the resulting volume of wastewater. The device according to the invention furthermore has the advantages of increasing the separating area per unit volume of separating liquid (increase in the inter-particle electrostatic forces, separating droplets of finer mean size), of avoiding the problem of a reduction in effectiveness of the electrostatic precipitation systems due to the accumulation on the separating electrodes of insulating dust particles, of not requiring a pressurization system or mechanical system and thus of avoiding the problems of a pressure drop in a filtration system at the end of the process (inertia separation is possible with the device according to the invention).

The device according to the invention furthermore has, in general, the advantages of a reduction in installation costs, energy costs and wastewater treatment costs (because of the small volumes of wastewater produced by the device according to the invention, from one liter to one cubic meter per hour). It also has the advantage of reliability: the percolation of the separating droplets on the walls used for inertial separation makes it possible to prevent the accumulation of the separated products on the electrodes, as is observed using the said devices of the prior art. The device according to the invention makes it possible, particularly advantageously, to work in a continuous manner.

According to a particularly preferred embodiment of the invention, the said device is therefore applied to inertial separation, following the electrical coagulation onto coarser droplets, of particles whose initial size is less than or equal to one micron, and especially of polluting particles of such a size, which are present in an aerosol, or in an effluent capable of being converted into an aerosol.

Such particles, because of their small sizes, could not hitherto be effectively removed from an aerosol by inertial separation after their coagulation onto the separating droplets. The device according to the invention, by controlling the size (or sizes) of charge particles produced, makes it possible to produce charged droplets whose size(s) is (are) optimal for causing them, after they have coagulated onto the said particles to be removed, to fall simply by inertia in a controlled and effective manner. With the device according to the invention it is not necessary to use filtration systems for the said separation. The pressure drops due to the use of such filtration systems are thus avoided. The device according to the invention also makes it possible to control the volume of water needed for this growth, and thus the volume of wastewater to be treated.

One means of varying the size(s) of droplets produced by the device according to the invention consists especially in varying the liquid flow rate, that is to say in varying the mechanical flow rate of liquid by varying the rate at which liquid is fed into the inlet of the said duct, or inside the latter, and/or in varying those of the properties intrinsic to the liquid which influence its flow rate, especially its conductivity properties (whether by modifying the properties of one and the same base liquid or by using various liquids of defined properties).

The said effluent or aerosol may especially come from an incineration plant in a chemical, metallurgical or glassmaking industry, from a boiler or from a thermal power station, from a road tunnel or from a vehicle, especially a diesel vehicle.

In another preferred embodiment of the invention, the said device is applied to the electroporation of biological (plant-based or animal-based) membranes for the transfer of organic molecules, and especially of nucleic acids.

The subject of the present invention is also an EHDS process characterized in that it employs at least one device according to the invention. It also relates to a process for the decontamination of aerosol effluents, or of effluents that can be converted into aerosols, from which it is desired to remove the polluting particles, characterized in that it comprises the steps of:

biasing the said polluting particles present in an aerosol;

producing a dispersion of liquid droplets of reverse polarity using at least one device according to the invention;

bringing the said dispersion of liquid droplets and the said biased polluting particles into contact with one another so as to allow the electrical coagulation of these polluting particles onto the said liquid droplets;

inertially separating the polluted liquid droplets.

The subject of the present invention is also an EHDS process, characterized in that a liquid which is biased at the outlet of a duct 1 is sprayed, in air at atmospheric pressure, by establishing a continuous discharge regime. The said liquid may have a surface tension greater than 0.055 N/m and, notably, greater than 0.065 N/m. Advantageously, the said duct 1 has, at the very least at the said outlet, external and internal diameters whose values, when they are expressed in the same units, satisfy the following relationship: (external diameter value)/(internal diameter value) greater than approximately 1.445, preferably greater than approximately 1.5697, more preferably greater than approximately 1.6 and even more preferably greater than or equal to approximately 1.8.

Figure 2:
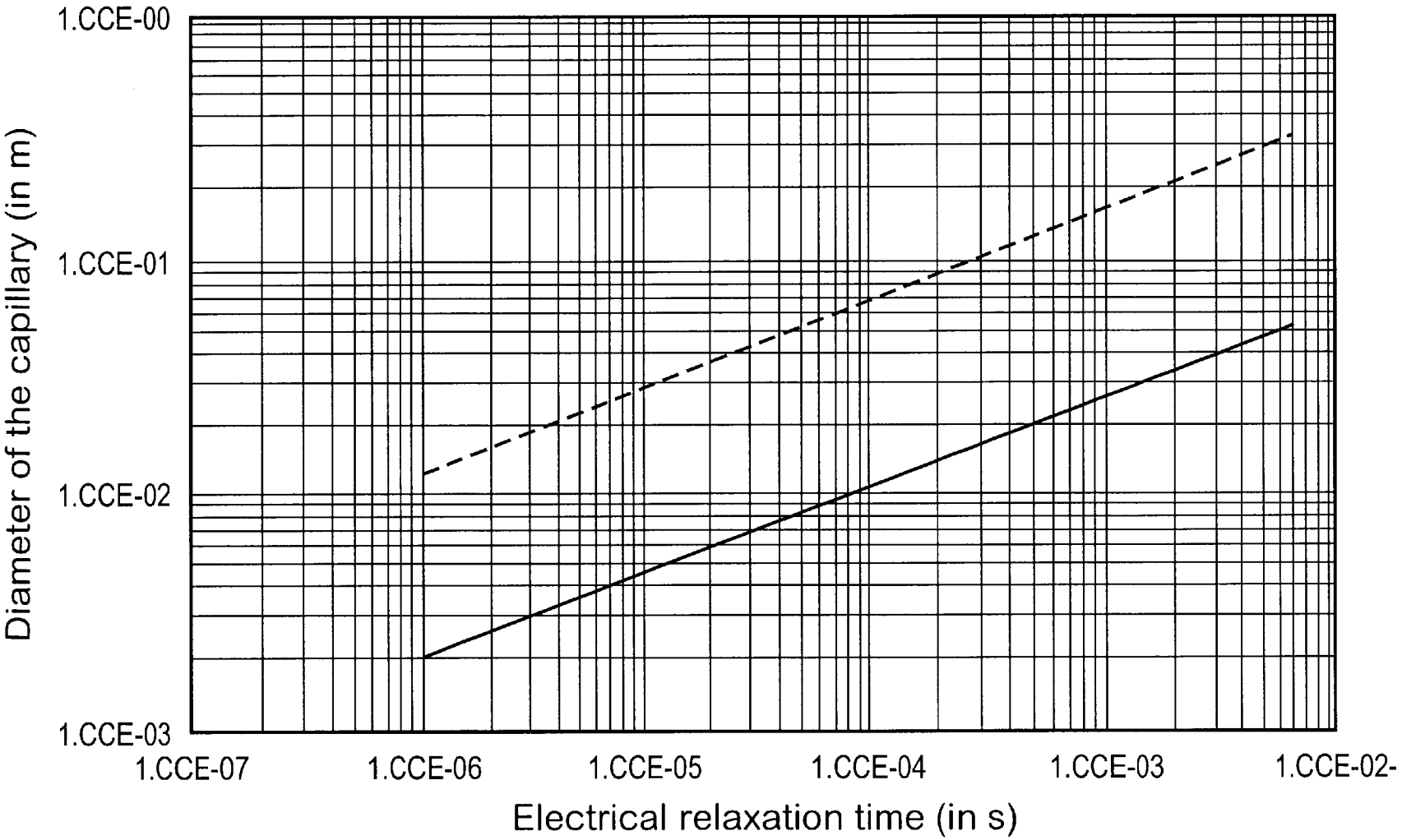
Figure 3:
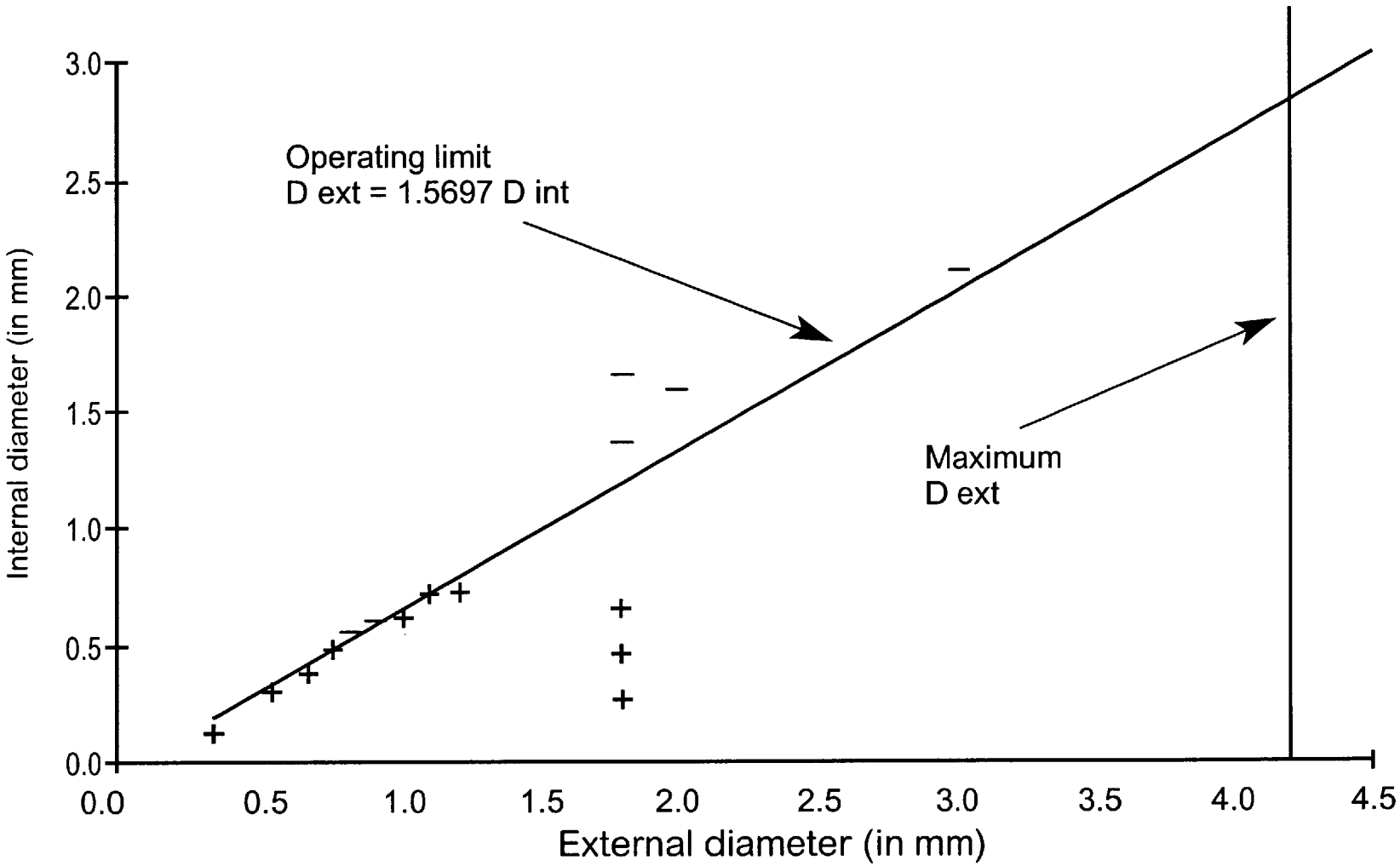
Figure 4:
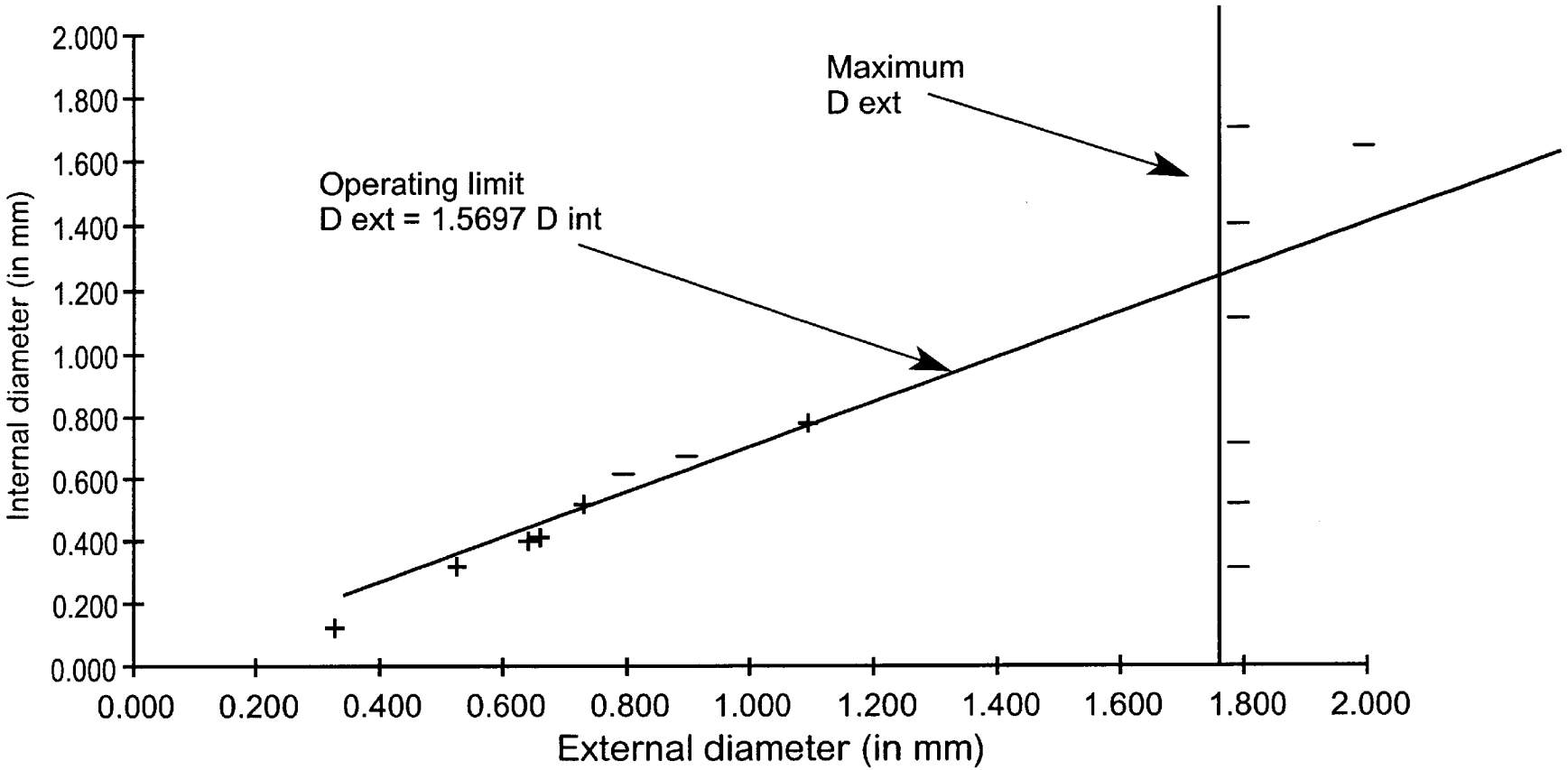
Figure 5:
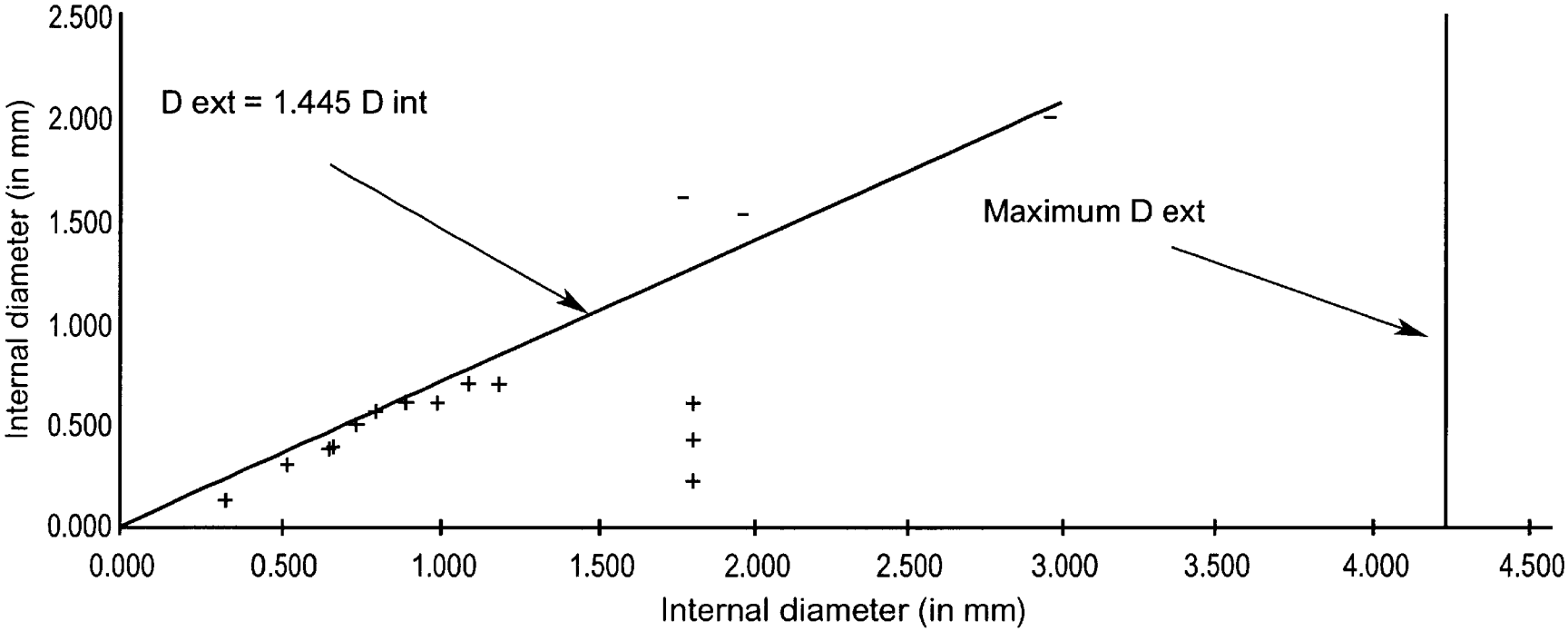
Figure 6:
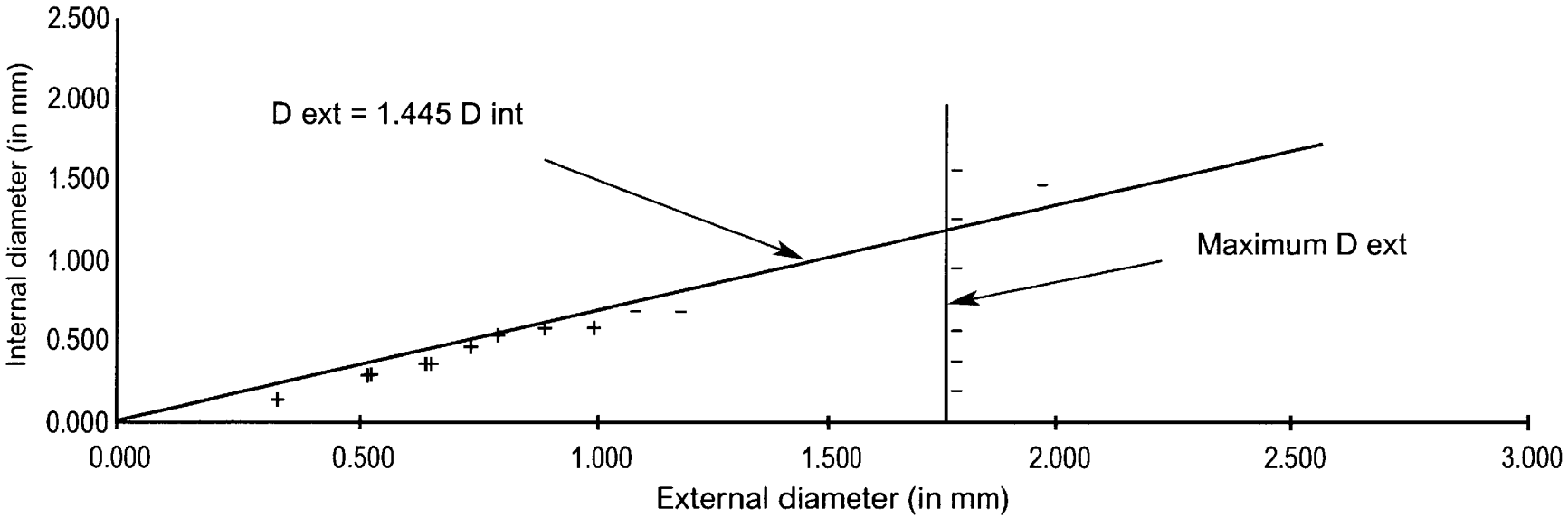

The characteristics and advantages of the present invention are illustrated by the following non-limiting examples. In these examples, reference is made to FIGS. 1 to 6 in which:

FIG. 1 shows one embodiment of the EHDS device according to the invention;

FIG. 2 shows a graph (capillary diameter in m as a function of the electrical relaxation time in s) from which may be read external duct diameter values suitable for producing an EHDS in air, at atmospheric pressure, and without a pulsed discharge regime, for liquids having a surface tension greater than 0.055 N/m and, notably, greater than 0.065 N/m (dotted line: limiting external duct diameter values for a high-viscosity liquid; solid line: limiting external duct diameter values for a low-viscosity liquid);

FIGS. 3 and 4 show, as a function of the internal diameter (in mm on the y-axis) and of the external diameter (in mm on the x-axis) of the ducts tested, that a probability equal to 1 (+ symbol) or of less than 1 (– symbol) is obtained for the EHDS, without a pulsed discharge regime, of a liquid having a conductivity of 100 $\mu$S/m (FIG. 3) and 1000 $\mu$S/m (FIG. 4) and with a surface tension greater than 0.055 N/m, and especially greater than 0.065 N/m: in these FIGS. 3 and 4, the straight line $D_{ext}$=1.5697 $D_{int}$ is plotted, this line tracing an operating limit of the capillary 1 according to one arrangement of the invention (in the presence of a metal support which support the said duct or capillary and is perpendicular to this duct, or capillary). A straight line (the vertical line $D_{max}$) marks the upper bound of appropriate external diameters;

FIGS. 5 and 6, like FIGS. 3 and 4, show that a probability equal to 1 (+ sign) or less than 1 (– sign) is obtained for the EHDS, without a pulsed discharge regime (in "cone-jet-glow" mode) of a liquid having a conductivity of 100 $\mu$S/m (FIG. 5) and 1000 $\mu$S/m (FIG. 6) and having a surface tension greater than 0.055 N/m, and especially greater than 0.065 N/m: plotted in these FIGS. 5 and 6 is the straight line $D_{ext}$=1.445 $D_{int}$ which traces an operating limit of the capillary 1 in another arrangement of the invention (no metal support perpendicular to the said duct or capillary). A straight line (the vertical line $D_{max}$) marks the upper bound of suitable external diameters.

EXAMPLE 1

An EHDS device is mounted as shown in FIG. 1. This EHDS device comprises in particular:

a liquid delivery duct, made of conducting material, or capillary, 1;

a positive DC high-voltage generator 2 (positive DC high voltage: 0–30 kV);

a protective resistor 3 (R=$10^6$ ohms);

a means 4 for collecting the discharge current in the gas surrounding the liquid, in the form of an earthed conducting annulus;

an earthed counterelectrode 5 allowing the charge on the sprayed liquid droplets to be collected; and a liquid feed pump 6.

The annulus 4 is placed at a distance d from the capillary 1 equal to 2 to 4 cm, so as to collect the gaseous ions created by the discharges in the gas surrounding the liquid, while leaving the spray of charged droplets to pass through it. A counterelectrode 5 (which is optional) is placed at a distance D from the capillary 1 so as to collect the charges from droplets of the spray. If it is desired to produce an aerosol of charged droplets in suspension in a gas, only the capillary 1 and the annulus 4 are essential.

The EHDS device also comprises, as illustrated in FIG. 1, analytical-and measurement means, namely:

an LDA (Laser Doppler Anemometry) system 7 making it possible, by means of laser radiation 9, to measure the particle size distribution of the charged droplets produced by the device according to the invention; and an oscilloscope 8 (200 MHz Oscillo) making it possible to measure the electric current carried by the spray produced.

The voltage applied to the liquid via the conducting capillary 1 is, for example, between approximately +1 kV and +30 kV for inter-electrode distances of the order of approximately 1 to 10 cm. Preferably, a positive voltage is applied since the threshold field for a negative discharge is less than the threshold field for a positive discharge, thereby making it possible to widen the range of voltages that can be applied to the liquid in the case of positive EHDSs.

The capillary 1 consists of a syringe needle. Various external diameters ($D_{ext}$) and internal diameters ($D_{int}$) of the capillary 1 were tested.

FIG. 2 shows a graph making it possible to read off the appropriate maximum external diameter value: depending on the electrical relaxation time in s (on the x-axis) of the liquid in question, the maximum external diameter value of the capillary in m (on the y-axis) is read off the solid line if the liquid is a low-viscosity liquid and off the dotted line if it is a high-viscosity liquid. The terms "low" viscosity and "high" viscosity should be understood to mean in accordance with the notions commonly accepted by those skilled in the art. Typically, a low viscosity should mean a viscosity of approximately 1 mPa·s, whereas a high viscosity should be understood to mean a viscosity more than two orders of magnitude higher (i.e. of the order of approximately 100 mpa·s). In this FIG. 2, the dotted line (high-viscosity liquids) satisfies the equation:

$$\log_{10}(\text{capillary diameter in m})=0.37793\times\log_{10}(\text{electrical relaxation time in s})+0.34674.$$

The solid line (low-viscosity liquids) satisfies the equation:

$$\log_{10}(\text{capillary diameter in m})=0.37747\times\log_{10}(\text{electrical relaxation time in s})+0.43141.$$

An external diameter value suitable for stable EHDS (no pulsed discharge regime) in air at atmospheric pressure, for a liquid having a high surface tension (greater than 0.055 N/m, and notably greater than 0.065 N/m) is chosen to be less than the limiting value read off FIG. 2.

In the trials referred to here, the external diameter values of the capillary 1 range from 0.324 to 1.8 mm. The results of the present example were obtained with capillaries placed on a conducting support placed perpendicular to the axis of the capillary.

Various internal diameter values of the capillary 1 are tested for each external diameter value; and each (external diameter—internal diameter) pair is tested with various liquids having a surface tension greater than 0.055 N/m and, notably, greater than 0.065 N/m, at room temperature (the liquids range from ultrapure water [conductivity: 10 $\mu$S/m; $\tau_q$: 70 $\mu$S] to water doped with conducting salts [conductivity: 1000 $\mu$S/m; $\tau_q$: $7\times10^{-7}$ S]).

The entire device according to the invention is placed in air and at atmospheric pressure, a positive DC voltage of between +1 and +30 kV is applied and the said device is fed with liquid. The LDA 7 and oscilloscope 8 systems make it possible to observe whether a stable or an unstable EHDS is obtained (absence or presence of a pulsed discharge regime). The probability of obtaining, for all the liquids tested, a stable EHDS for each $D_{ext}/D_{int}$ pair tested is then calculated.

Table 1 below gives results thus obtained with a liquid whose conductivity is 100 $\mu$S/m

TABLE 1

| Capillary external diameter $D_{ext}$ (mm) | Capillary internal diameter $D_{int}$ (mm) | $D_{ext}/D_{int}$ | Probability of a stable EHDS in cone-jet-glow mode, ($P_{cjm}$) |
|---|---|---|---|
| 1.800 | 0.200 | 9.000 | =1 |
| 1.800 | 0.400 | 4.500 | =1 |
| 1.800 | 0.600 | 3.000 | =1 |
| 1.800 | 1.300 | 1.380 | <1 |
| 1.800 | 1.600 | 1.130 | <1 |
| 0.900 | 0.600 | 1.500 | <1 |
| 1.100 | 0.700 | 1.570 | =1 |
| 3.000 | 2.000 | 1.500 | <1 |
| 1.000 | 0.600 | 1.666 | =1 |
| 1.200 | 0.700 | 1.780 | =1 |
| 2.000 | 1.520 | 1.316 | <1 |
| 0.324 | 0.122 | 2.667 | =1 |
| 0.525 | 0.300 | 1.750 | =1 |
| 0.657 | 0.375 | 1.750 | =1 |
| 0.518 | 0.296 | 1.750 | =1 |
| 0.643 | 0.367 | 1.750 | =1 |
| 0.740 | 0.471 | 1.570 | =1 |
| 0.800 | 0.554 | 1.445 | <1 |

Plotted in FIG. 3, for various pairs of values (internal diameter of the capillary 1; external diameter of the capillary 1), are these EHDS results obtained with a liquid whose conductivity is 100 $\mu$S/m: the + symbol indicates that a stable EHDS is obtained (no pulsed discharge regime), that is to say that a stable "cone-jet-glow" mode with a probability of 1 is obtained; the – symbol indicates that an unstable EHDS is obtained (presence of a pulsed discharge regime), that is to say that an unstable (non-permanent "cone-jet-glow") mode is obtained, and therefore one having a probability of less than 1.

Table 2 below gives results thus obtained for a liquid whose conductivity is 1000 $\mu$S/m.

TABLE 2

| Capillary external diameter $D_{ext}$ (mm) | Capillary internal diameter $D_{int}$ (mm) | $D_{ext}/D_{int}$ | Probability of a stable EHDS in cone-jet-glow mode, ($P_{cjm}$) |
|---|---|---|---|
| 0.900 | 0.600 | 1.500 | <1 |
| 0.324 | 0.122 | 2.667 | =1 |
| 0.525 | 0.300 | 1.750 | =1 |
| 0.657 | 0.375 | 1.750 | =1 |
| 0.518 | 0.296 | 1.750 | =1 |
| 0.643 | 0.367 | 1.750 | =1 |
| 0.740 | 0.471 | 1.570 | =1 |
| 0.800 | 0.554 | 1.445 | <1 |
| 1.800 | 0.200 | 9.000 | <1 |
| 1.800 | 0.400 | 4.500 | <1 |
| 1.800 | 0.600 | 3.000 | <1 |
| 1.800 | 1.000 | 1.800 | <1 |
| 1.800 | 1.300 | 1.380 | <1 |
| 1.800 | 1.600 | 1.130 | <1 |
| 1.100 | 0.700 | 1.570 | =1 |
| 3.000 | 2.000 | 1.500 | <1 |
| 2.000 | 1.520 | 1.316 | <1 |

Plotted in FIG. 4, for various pairs of (internal diameter of the capillary 1: external diameter of the capillary 1) values, are these EHDS results obtained with a liquid whose conductivity is 1000 $\mu$S/m: the + symbol indicates that a stable EHDS is obtained (no pulsed discharge regime) that is to say that a stable "cone-jet-glow" mode with a probability of 1 is obtained; the – symbol indicates that an unstable EHDS is obtained (presence of a pulsed discharge regime), that is to say that a stable "cone-jet-glow" mode is obtained with a probability of less than 1.

The above Tables 1 and 2, as well as FIGS. 3 and 4, demonstrate that, if the values of $D_{ext}$ and $D_{int}$ satisfy an appropriate equation, an EHDS without a pulsed discharge regime can be obtained, in air and at atmospheric pressure, for a liquid having a surface tension of greater than 0.055 N/m and, notably, greater than 0.065 N/m, with a probability equal to 1. For example, for $D_{ext}$ values ranging up to a value of approximately (maximum $D_{ext}$)/3, a suitable equation may be calculated and read off FIG. 3 (for a liquid having a conductivity of 100 μS/m) and FIG. 4 (for a liquid having a conductivity of 1000 μS/m) as being: $D_{ext}/D_{int}$ ratio of the capillary 1 greater than approximately 1.5697. The same procedure is carried out on the remaining $D_{ext}$ ranges (up to the maximum $D_{ext}$).

Tables 3 and 4 below show, for each external diameter $D_{ext}$ of the capillary 1 given in Table 1 (for a liquid having a conductivity of 100 μS/m) and Table 2 (for a liquid having a conductivity of 1000 μS/m), the maximum internal diameter value $D_{int}$ of the capillary 1 which can thus be used, in accordance with the invention, so as to obtain an EHDS without a pulsed discharge regime in air and at atmospheric pressure for a liquid having a surface tension greater than 0.055 N/m and, notably, greater than 0.065 N/m (equation $D_{ext}$=1.5697 $D_{int}$ for $D_{ext}$ values of less than approximately ⅓ of the maximum $D_{ext}$).

TABLE 3

(liquid of 100 μS/m conductivity)

| Capillary external diameter $D_{ext}$ (mm) | Calculated maximum $D_{int}$ (mm) |
|---|---|
| 1.800 | 1.154 |
| 0.900 | 0.577 |
| 1.100 | 0.705 |
| 3.000 | 1.923 |
| 1.000 | 0.641 |
| 1.200 | 0.769 |
| 2.000 | 1.282 |
| 0.324 | 0.208 |
| 0.525 | 0.337 |
| 0.657 | 0.421 |
| 0.518 | 0.332 |
| 0.643 | 0.412 |
| 0.740 | 0.474 |
| 0.800 | 0.513 |

TABLE 4

(liquid of 1000 μS/m conductivity)

| Capillary external diameter $D_{ext}$ (mm) | Calculated maximum $D_{int}$ (mm) |
|---|---|
| 0.900 | 0.573 |
| 0.324 | 0.206 |
| 0.525 | 0.334 |
| 0.657 | 0.418 |
| 0.518 | 0.330 |
| 0.643 | 0.410 |
| 0.740 | 0.471 |
| 0.800 | 0.510 |
| 1.800 | 1.147 |

TABLE 4-continued (liquid of 1000 μS/m conductivity)

| Capillary external diameter $D_{ext}$ (mm) | Calculated maximum $D_{int}$ (mm) |
|---|---|
| 1.100 | 0.701 |
| 3.000 | 1.911 |
| 2.000 | 1.274 |

EXAMPLE 2

Experiments were carried out in a similar manner to those described in Example 1 above, but with the absence of a conducting support supporting the said capillary or duct 1.

The results obtained are given in Table 5 (liquid of 100 μS/m conductivity) and Table 6 (liquid of 1000 μS/m conductivity) below.

TABLE 5

Nozzle diameters for the electrohydrodynamic spraying of water in stable cone-jet-glow mode ($P_{cjg\ mode}$ = 1) or unstable cone-jet-glow mode ($P_{cjg\ mode}$ < 1) for water having a conductivity of 1000 μS/m:

| $D_{ext}$ (mm) | $D_{int}$ (mm) $P_{cjg\ mode}$ = 1 | $D_{int}$ (mm) $P_{cjg\ mode}$ < 1 | Calculated maximum $D_{int}$ (mm): $D_{ext}$ = 1.445 $D_{int}$ | $D_{ext}/D_{int}$ |
|---|---|---|---|---|
| 1.800 | 0.200 | | 1.154 | 9.000 |
| 1.800 | 0.400 | | 1.154 | 4.500 |
| 1.800 | 0.600 | | 1.154 | 3.000 |
| 1.800 | | 1.600 | 1.154 | 1.130 |
| 0.900 | 0.600 | | 0.577 | 1.500 |
| 1.100 | 0.700 | | 0.705 | 1.570 |
| 3.000 | | 2.000 | 1.923 | 1.500 |
| 1.000 | 0.600 | | 0.641 | 1.666 |
| 1.200 | 0.700 | | 0.769 | 1.780 |
| 2.000 | | 1.520 | 1.282 | 1.316 |
| 0.324 | 0.122 | | 0.208 | 2.667 |
| 0.525 | 0.300 | | 0.337 | 1.750 |
| 0.657 | 0.375 | | 0.421 | 1.750 |
| 0.518 | 0.296 | | 0.332 | 1.750 |
| 0.643 | 0.367 | | 0.412 | 1.750 |
| 0.740 | 0.471 | | 0.474 | 1.570 |
| 0.800 | 0.554 | | 0.513 | 1.445 |

TABLE 6

Nozzle diameters for the electrohydrodynamic spraying of water in stable cone-jet-glow mode ($P_{cjg\ mode}$ = 1) or unstable cone-jet-glow mode ($P_{cjg\ mode}$ < 1) for water having a conductivity of 1000 μS/m

| $D_{ext}$ (mm) | $D_{int}$ (mm) $P_{cjg\ mode}$ = 1 | $D_{int}$ (mm) $P_{cjg\ mode}$ < 1 | Calculated maximum $D_{int}$ (mm): $D_{ext}$ = 1.445 $D_{int}$ | $D_{ext}/D_{int}$ |
|---|---|---|---|---|
| 0.900 | 0.600 | | 0.573 | 1.500 |
| 1.000 | 0.600 | | 0.637 | 1.666 |
| 0.324 | 0.122 | | 0.206 | 2.667 |
| 0.525 | 0.300 | | 0.334 | 1.750 |
| 0.657 | 0.375 | | 0.418 | 1.750 |
| 0.518 | 0.296 | | 0.330 | 1.750 |
| 0.643 | 0.367 | | 0.410 | 1.750 |
| 0.740 | 0.471 | | 0.471 | 1.570 |
| 0.800 | 0.554 | | 0.510 | 1.445 |
| 1.800 | | 0.200 | 1.147 | 9.000 |

TABLE 6-continued

Nozzle diameters for the electrohydrodynamic spraying of water in stable cone-jet-glow mode ($P_{cjg\ mode}$ = 1) or unstable cone-jet-glow mode ($P_{cjg\ mode}$ < 1) for water having a conductivity of 1000 μS/m

| $D_{ext}$ (mm) | $D_{int}$ (mm) $P_{cjg\ mode}$ = 1 | $D_{int}$ (mm) $P_{cjg\ mode}$ < 1 | Calculated maximum $D_{int}$ (mm): $D_{ext}$ = 1.445 $D_{int}$ | $D_{ext}$/ $D_{int}$ |
|---|---|---|---|---|
| 1.800 | | 0.400 | 1.147 | 4.500 |
| 1.800 | | 0.600 | 1.147 | 3.000 |
| 1.800 | | 1.600 | 1.147 | 1.800 |
| 1.800 | | 1.300 | 1.147 | 1.380 |
| 1.800 | | 1.600 | 1.147 | 1.130 |
| 1.100 | | 0.700 | 0.701 | 1.570 |
| 3.000 | | 2.000 | 1.911 | 1.500 |
| 1.200 | | 0.700 | 0.764 | 1.780 |
| 2.000 | | 1.520 | 1.274 | 1.316 |

These results are illustrated respectively in FIGS. 5 and 6. FIG. 5 illustrates the results given in Table 5 (liquid of 100 μS/m conductivity; $\tau_q$=7.143136×10$^6$; low-viscosity liquid: the + sign indicates a probability of stable EHDS in "cone-jet-glow" mode equal to 1; the – sign indicates a probability of less than 1 (instability of the "cone-jet-glow" mode over time); the straight line through the limiting operating values which is obtained satisfies the equation $D_{ext}$=1.445 $D_{int}$ with a maximum $D_{ext}$ of 4.22 mm. FIG. 6 uses the same symbols as in FIG. 5 and illustrates the results from Table 6 (liquid of 1000 μS/m conductivity, $\tau_q$=7.143136×10$^{-7}$; low-viscosity liquid); the straight line through the limiting operating values satisfies the equation $D_{ext}$=1.445 $D_{int}$, but with a maximum $D_{ext}$ of 1.77 mm.

What is claimed is:

1. Electrohydrodynamic spray device comprising at least one duct at an outlet of which a biased liquid can be sprayed, wherein it comprises means at least at the outlet of the duct which spray, in air and at atmospheric pressure, a liquid whose surface tension is greater than 0.055 N/m while generating a continuous discharge regime, wherein the means comprise, at least at the outlet, an external diameter value of the duct less than a limiting value $D_{max}$ which satisfies the equation:

$$\log_{10}(D_{max})=0.37793\times\log_{10}(\tau_g)+0.34674$$

when the liquid has a high viscosity;
or the equation:

$$\log_{10}(D_{max})=0.37747\times\log_{10}(\tau_q)+0.43141$$

when the liquid has a low viscosity, where $D_{max}$ is the limiting value in m and $\tau_q$ is the electrical relaxation constant of the liquid in s.

2. Device according to claim 1, wherein the means comprise, at least at the outlet, external and internal diameters of the duct which make it possible to generate, in air and at atmospheric pressure, a stable liquid fragmentation mode.

3. Device according to claim 2, wherein the stable liquid fragmentation mode is a stable "cone-jet-glow" mode.

4. Device according to claim 1, wherein it furthermore comprises means making it possible to apply an electrical voltage to the liquid upstream of, or while it is flowing in, the duct, so as to bias it.

5. Device according to claim 4, herein the voltage is a DC voltage.

6. Device according to claim 5, wherein the DC voltage is a positive DC voltage.

7. Device according to claim 6, wherein the DC voltage is less than approximately 30 kV.

8. Device according to claim 1, wherein it furthermore comprises means making it possible to unbias the liquid after spraying.

9. Device according to claim 8, wherein the means making it possible to unbias the liquid after spraying comprises an earthed electrically conducting material.

10. Device according to claim 1, wherein it furthermore comprises means making it possible when spraying the liquid, to collect a discharge current in the gas surrounding the liquid.

11. Device according to claim 10, wherein the means making it possible when spraying the liquid, to collect a discharge current in the gas surrounding the biased liquid, comprises a conducting material having an opening of shape and size allowing the sprayed liquid to flow while collecting the discharge current.

12. Device according to claim 1, wherein the liquid whose surface tension is greater than 0.055 N/m is essentially a solution (solvent and neutral or ionic, organic or mineral solute(s)), or a mixture of solutions selected from the group consisting of water, ultrapure water, distilled water, water containing conducting salts, an organic solvent to which one or more surfactant molecules have been added, ethanol to which one or more surfactant molecules have been added, acetone to which one or more surfactant molecules have been added and ethylene glycol to which one or more surfactant molecules have been added.

13. Device for the separation of particles present in an aerosol, following the electrical coagulation onto coarser droplets, of particles whose initial size is less than or equal to one micron, which are present in an aerosol, wherein it employs a device according to claim 1.

14. Device according to claim 13, wherein the device is for inertial separation of polluting particles.

15. Device for electroporation of a biological membrane for the transfer of organic molecules, wherein it employs a device according to claim 1.

16. Device according to claim 15, wherein the organic molecules comprise nucleic acids.

17. Electrohydrodynamic spray device comprising at least one duct at an outlet of which a biased liquid can be sprayed, wherein it comprises means at least at the outlet of the duct which spray, in air and at atmospheric pressure, a liquid whose surface tension is greater than 0.065 N/m while generating a continuous discharge regime, wherein the means comprise, at least at the outlet, an external diameter value of the duct less than a limiting value $D_{max}$ which satisfies the equation:

$$\log_{10}(D_{max})=0.37793\times\log_{10}(\tau_q)+0.34674$$

when the liquid has a high viscosity;
or the equation:

$$\log_{10}(D_{max})=0.37747\times\log_{10}(\tau_q)+0.43141$$

when the liquid has a low viscosity, where $D_{max}$ is the limiting value in m and $\tau_q$ is the electrical relaxation constant of the liquid in s.

18. Device according to claim 17, wherein the means comprise, at least at the outlet, external and internal diameter values of the duct which, when they are expressed in the same units, satisfy the following relationship:

(external diameter value)/(internal diameter value) is greater than approximately 1.445.

19. Device according to claim 2, wherein the external and internal diameter values of the duct satisfy the following relationship:

(external diameter value)/(internal diameter value) is greater than approximately 1.5697.

20. Device according to claim 19, wherein the external and internal diameter values of the duct satisfy the following relationship:

(external diameter value)/(internal diameter value) is greater than approximately 1.6.

21. Device according to claim 17, wherein the means comprise, at least at the outlet, external and internal diameter values of the duct which, when they are expressed in the same units, satisfy the following relationship:

(external diameter value)/(internal diameter value) is greater than approximately 1.8.

22. Electrohydrodynamic spray device comprising at least one duct at an outlet of which a biased liquid can be sprayed, wherein it comprises means at least at the outlet of the duct which spray, in air and at atmospheric pressure, a liquid whose surface tension is greater than 0.065 N/m while generating a continuous discharge regime, wherein it furthermore comprises liquid feed means allowing a mean operating liquid flow rate at the inlet, or inside the duct, having a value in $m^3 \cdot s^{-1}$ which lies within a range varying by a factor of approximately 10 between its upper bound and its lower bound, the range comprising, a value able to satisfy the following formula:

$$A[(4/3\ \pi r^3]/\tau_q,$$

A being a constant, different from 0 and from 1, lying between approximately 0.1 and 10 and preferably equal to approximately 0.5, r being the desired drop radius expressed in m and $\tau_q$ being the electrical relaxation constant of the liquid expressed in s.

23. Device according to claim 22, wherein the range comprises, centrally, a value able to satisfy the formula recited in claim 22.

24. Device according to claim 1, wherein the continuous discharge regime is a glow regime or a Hermstein regime.

* * * * *